US009932947B2

(12) United States Patent
Nehl et al.

(10) Patent No.: US 9,932,947 B2
(45) **Date of Patent: *Apr. 3, 2018**

(54) ACTUATOR WITH RESIDUAL MAGNETIC HYSTERESIS RESET

(71) Applicant: GM GLOBAL TECHNOLOGY OPERATIONS LLC, Detroit, MI (US)

(72) Inventors: Thomas Wolfgang Nehl, Shelby Township, MI (US); Suresh Gopalakrishnan, Troy, MI (US); Chandra S. Namuduri, Troy, MI (US); Avoki M. Omekanda, Rochester, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 530 days.

This patent is subject to a terminal disclaimer.

(21) Appl. No.: 14/643,872

(22) Filed: Mar. 10, 2015

(65) Prior Publication Data

US 2015/0267660 A1 Sep. 24, 2015

Related U.S. Application Data

(60) Provisional application No. 61/955,942, filed on Mar. 20, 2014, provisional application No. 61/968,001, filed on Mar. 20, 2014.

(51) Int. Cl.
*H01H 47/22* (2006.01)
*H01H 47/32* (2006.01)
(Continued)

(52) U.S. Cl.
CPC ..... *F02M 51/0625* (2013.01); *F02D 41/20* (2013.01); *H01F 7/1872* (2013.01);
(Continued)

(58) Field of Classification Search
CPC ..... H01H 47/22; H01H 47/04; H01H 47/32
(Continued)

(56) References Cited

U.S. PATENT DOCUMENTS 5,381,297 A 1/1995 Weber
5,831,809 A 11/1998 Schmitz
(Continued)

FOREIGN PATENT DOCUMENTS

DE 3437053 C2 6/1985
DE 196 43 788 A1 5/1998
(Continued)

OTHER PUBLICATIONS

A. M. Pawlak, Transient Finite Element Modeling of Solenoid Actuators, IEEE Transactions on Magnetics, Jan. 1988, 270-273, vol. 24, No. 1.
(Continued)

*Primary Examiner* — Dharti Patel

(57) ABSTRACT

An electromagnetic actuation system includes an electrical coil, a magnetic core, an armature, a controllable bi-directional drive circuit for selectively driving current through the coil in either of two directions, and a control module providing an actuator command to the drive circuit. Current is driven though the electrical coil in a first direction when an actuation is desired. When the actuation is not desired current is driven through the electrical coil including in a second direction sufficient to reduce residual flux within the actuator below a level passively attained within the actuator at zero coil current.

17 Claims, 4 Drawing Sheets

(51) Int. Cl.

| | |
|---|---|
| ***H01H 47/04*** | (2006.01) |
| ***F02M 51/06*** | (2006.01) |
| ***H01F 7/18*** | (2006.01) |
| *F02D 41/20* | (2006.01) |
| *F02D 41/40* | (2006.01) |

(52) U.S. Cl.
CPC .... *F02D 41/402* (2013.01); *F02D 2041/2037* (2013.01); *F02D 2041/2044* (2013.01); *F02D 2041/2058* (2013.01); *F02D 2041/2072* (2013.01)

(58) Field of Classification Search
USPC ..... 361/160
See application file for complete search history.

(56) References Cited

U.S. PATENT DOCUMENTS

| | | | |
|---|---|---|---|
| 6,168,135 | B1 | 1/2001 | Fochtman |
| 6,321,700 | B1 | 11/2001 | Hein |
| 9,726,099 | B2 * | 8/2017 | Namuduri ..... F02D 41/1401 |
| 9,726,100 | B2 * | 8/2017 | Gopalakrishnan .. F02D 41/1401 |
| 2002/0057156 | A1 | 5/2002 | Czimmek |
| 2002/0148442 | A1 | 10/2002 | Fraenkle |
| 2003/0184946 | A1 | 10/2003 | Kolmanovsky |
| 2007/0056784 | A1 | 3/2007 | Joe |
| 2007/0120332 | A1 | 5/2007 | Bushko |
| 2007/0285195 | A1 | 12/2007 | Nehl |
| 2008/0204178 | A1 | 8/2008 | Maranville |
| 2010/0018503 | A1 | 1/2010 | Perry |
| 2011/0125391 | A1 | 5/2011 | McAlister |
| 2012/0018262 | A1 | 1/2012 | Winkler |
| 2012/0101707 | A1 | 4/2012 | Kemmer |
| 2012/0239278 | A1 | 9/2012 | Becker |
| 2012/0247428 | A1 | 10/2012 | Grimminger |
| 2013/0113407 | A1 | 5/2013 | Neelakantan |
| 2013/0133748 | A1 | 5/2013 | Lehner |
| 2014/0069533 | A1 | 3/2014 | Gorzen |
| 2014/0092516 | A1 | 4/2014 | Koch |
| 2014/0110508 | A1 | 4/2014 | Dames |
| 2015/0123662 | A1 | 5/2015 | Yasui |
| 2015/0267661 | A1 | 9/2015 | Namuduri |
| 2015/0267662 | A1 | 9/2015 | Nehl |
| 2015/0267663 | A1 | 9/2015 | Namuduri |
| 2015/0267666 | A1 | 9/2015 | Gopalakrishnan |
| 2015/0267667 | A1 | 9/2015 | Namuduri |
| 2015/0267668 | A1 | 9/2015 | Gopalakrishnan |
| 2015/0267669 | A1 | 9/2015 | Nehl |
| 2015/0267670 | A1 | 9/2015 | Nehl |
| 2015/0285175 | A1 | 10/2015 | Parrish |

FOREIGN PATENT DOCUMENTS

| | | | |
|---|---|---|---|
| DE | 19921938 | A1 | 12/1999 |
| DE | 102005042110 | A1 | 3/2007 |
| DE | 10 2007 053 877 | B3 | 4/2009 |
| DE | 102012208781 | B4 | 11/2013 |
| DE | 102011083007 | A1 | 3/2015 |
| EP | 0 074 420 | A1 | 3/1983 |
| EP | 1670005 | A2 | 6/2006 |
| EP | 2336544 | A1 | 6/2011 |
| JP | 10-311265 | A | 11/1998 |
| JP | 2007-270658 | A | 10/2007 |
| KR | 10-2002-0094494 | A | 12/2002 |
| WO | WO 90-02872 | A1 | 3/1990 |
| WO | WO 87-01765 | A1 | 3/1997 |
| WO | WO 2015 143107 | A1 | 9/2015 |
| WO | WO 2015 143109 | A1 | 9/2015 |
| WO | WO 2015 143116 | A1 | 9/2015 |

OTHER PUBLICATIONS

T. W. Nehl, ANTIC85: A General Purpose Finite Element Package for Computer Aided Design, IEEE Transactions on Magnetics, Jan. 1988, 358-361, vol. 24, No. 1.

* cited by examiner

ACTUATOR WITH RESIDUAL MAGNETIC HYSTERESIS RESET

CROSS REFERENCE TO RELATED APPLICATIONS

This application claims the benefit of U.S. Provisional Application No. 61/955,942, filed on Mar. 20, 2014, and U.S. Provisional Application No. 61/968,001, filed on Mar. 20, 2014, both of which are incorporated herein by reference.

TECHNICAL FIELD

This disclosure is related to solenoid-activated actuators.

BACKGROUND

The statements in this section merely provide background information related to the present disclosure. Accordingly, such statements are not intended to constitute an admission of prior art.

Solenoid actuators can be used to control fluids (liquids and gases), or for positioning or for control functions. A typical example of a solenoid actuator is the fuel injector. Fuel injectors are used to inject pressurized fuel into a manifold, an intake port, or directly into a combustion chamber of internal combustion engines. Known fuel injectors include electromagnetically-activated solenoid devices that overcome mechanical springs to open a valve located at a tip of the injector to permit fuel flow therethrough. Injector driver circuits control flow of electric current to the electromagnetically-activated solenoid devices to open and close the injectors. Injector driver circuits may operate in a peak-and-hold control configuration or a saturated switch configuration.

Fuel injectors are calibrated, with a calibration including an injector activation signal including an injector open-time, or injection duration, and a corresponding metered or delivered injected fuel mass operating at a predetermined or known fuel pressure. Injector operation may be characterized in terms of injected fuel mass per fuel injection event in relation to injection duration. Injector characterization includes metered fuel flow over a range between high flow rate associated with high-speed, high-load engine operation and low flow rate associated with engine idle conditions.

It is known for engine control to benefit from injecting a plurality of small injected fuel masses in rapid succession. Generally, when a dwell time between consecutive injection events is less than a dwell time threshold, injected fuel masses of subsequent fuel injection events often result in a larger delivered magnitude than what is desired even through equal injection durations are utilized. Accordingly, such subsequent fuel injection events can become unstable resulting in unacceptable repeatability. This undesirable occurrence is attributed to the existence of residual magnetic flux within the fuel injector that is produced by the preceding fuel injection event that offers some assistance to the immediately subsequent fuel injection event. The residual magnetic flux is produced in response to persistent eddy currents and magnetic hysteresis within the fuel injector as a result of shifting injected fuel mass rates that require different initial magnetic flux values. It is further known to control armature bounce after the fuel injector closes by applying successive uni-directional positive current pulses. While generally effective to control armature bounce, the uni-directional positive current pulses are known to result in a presence of residual flux at steady state.

SUMMARY

An electromagnetic actuation system includes an electrical coil, a magnetic core, an armature, a controllable bi-directional drive circuit for selectively driving current through the coil in either of two directions, and a control module providing an actuator command to the drive circuit. Current is driven though the electrical coil in a first direction when an actuation is desired. When the actuation is not desired current is driven through the electrical coil including in a second direction sufficient to reduce residual flux within the actuator below a level passively attained within the actuator at zero coil current.

BRIEF DESCRIPTION OF THE DRAWINGS

One or more embodiments will now be described, by way of example, with reference to the accompanying drawings, in which:

FIG. 1-2 illustrates a schematic sectional view of the activation controller of FIG. 1-1, in accordance of the present disclosure;

FIG. 1-3 illustrates a schematic sectional view of an injector driver of FIGS. 1-1 and 1-2, in accordance to the present disclosure;

FIG. 2 illustrates a non-limiting exemplary plot of unidirectional current flow and magnetic flux profiles within a fuel injector for a fuel injection event without a flux reset event, in accordance with the present disclosure;

FIG. 3 illustrates a non-limiting exemplary plot of current flow and magnetic flux profiles for the fuel injection event of FIG. 2 using a flux reset event to reduce residual flux to zero, in accordance with the present disclosure;

DETAILED DESCRIPTION

This disclosure describes the concepts of the presently claimed subject matter with respect to an exemplary application to linear motion fuel injectors. However, the claimed subject matter is more broadly applicable to any linear or non-linear electromagnetic actuator that employs an electrical coil for inducing a magnetic field within a magnetic core resulting in an attractive force acting upon a movable armature. Typical examples include fluid control solenoids, gasoline or diesel or CNG fuel injectors employed on internal combustion engines and non-fluid solenoid actuators for positioning and control.

Figure 1:
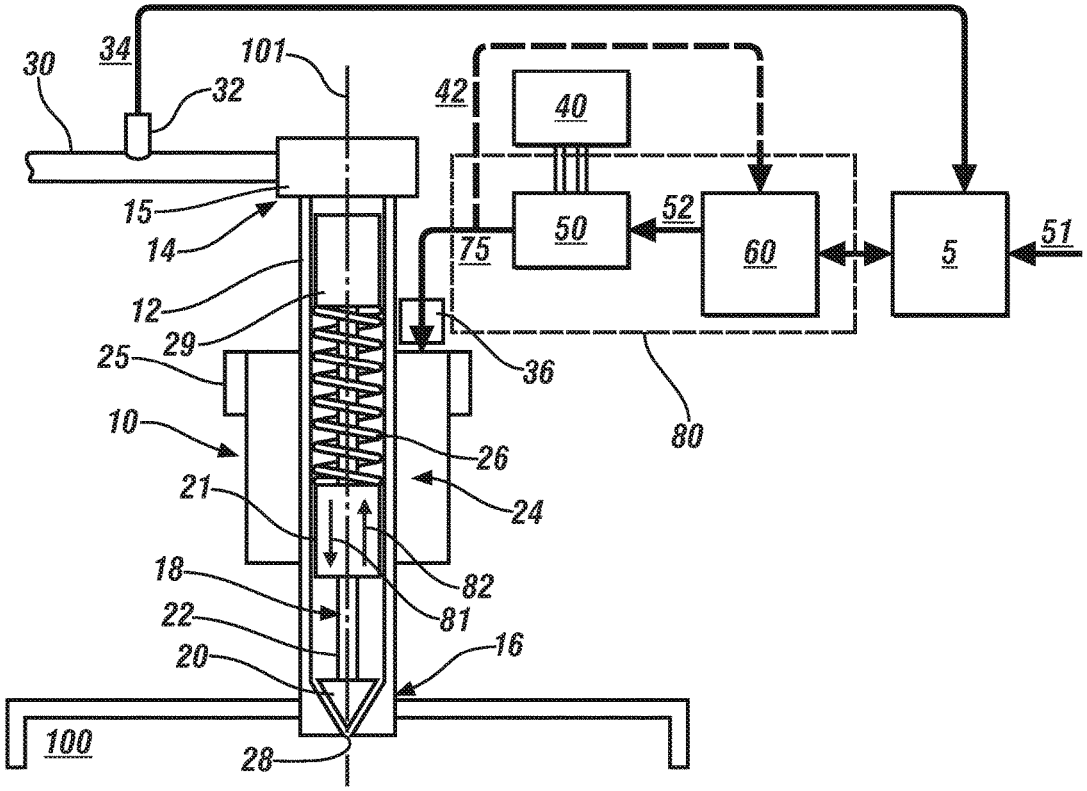
FIG. 1-1 illustrates a schematic sectional view of a fuel injector and an activation controller, in accordance with the present disclosure.

Referring now to the drawings, wherein the showings are for the purpose of illustrating certain exemplary embodiments only and not for the purpose of limiting the same, FIG. 1-1 schematically illustrates a non-limiting exemplary embodiment of an electromagnetically-activated direct-injection fuel injector 10. While an electromagnetically-activated direct-injection fuel injector is depicted in the illustrated embodiment, a port-injection fuel injector is equally applicable. The fuel injector 10 is configured to inject fuel directly into a combustion chamber 100 of an internal combustion engine. An activation controller 80 electrically operatively connects to the fuel injector 10 to control activation thereof. The activation controller 80 corresponds to only the fuel injector 10. In the illustrated embodiment, the activation controller 80 includes a control module 60 and an injector driver 50. The control module 60 electrically operatively connects to the injector driver 50 that electrically operatively connects to the fuel injector 10 to control activation thereof. The fuel injector 10, control module 60 and injector driver 50 may be any suitable devices that are configured to operate as described herein. In the illustrated embodiment, the control module 60 includes a processing device. In one embodiment, one or more components of the activation controller 80 are integrated within a connection assembly 36 of the fuel injector 36. In another embodiment, one or more components of the activation controller 80 are integrated within a body 12 of the fuel injector 10. In even yet another embodiment, one or more components of the activation controller 80 are external to—and in close proximity with—the fuel injector 10 and electrically operatively connected to the connection assembly 36 via one or more cables and/or wires. The terms "cable" and "wire" will be used interchangeably herein to provide transmission of electrical power and/or transmission of electrical signals.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

In general, an armature is controllable to one of an actuated position and a static or rest position. The fuel injector 10 may be any suitable discrete fuel injection device that is controllable to one of an open (actuated) position and a closed (static or rest) position. In one embodiment, the fuel injector 10 includes a cylindrically-shaped hollow body 12 defining a longitudinal axis 101. A fuel inlet 15 is located at a first end 14 of the body 12 and a fuel nozzle 28 (the fuel nozzle maybe a single opening or multiple holes in the case of a ball shaped valve) is located at a second end 16 of the body 12. The fuel inlet 15 is fluidly coupled to a high-pressure fuel line 30 that fluidly couples to a high-pressure injection pump. A valve assembly 18 is contained in the body 12, and includes a needle valve 20, a spring-activated pintle 22 and an armature portion 21. The needle valve 20 interferingly seats in the fuel nozzle 28 to control fuel flow therethrough. While the illustrated embodiment depicts a triangularly-shaped needle valve 20, other embodiments may utilize a ball. In one embodiment, the armature portion 21 is fixedly coupled to the pintle 22 and configured to linear translate as a unit with the pintle 22 and the needle valve 20 in first and second directions 81, 82, respectively. In another embodiment, the armature portion 21 may be slidably coupled to the pintle 22. For instance, the armature portion 21 may slide in the first direction 81 until being stopped by a pintle stop fixedly attached to the pintle 22. Likewise, the armature portion 21 may slide in the second direction 82 independent of the pintle 22 until contacting a pintle stop fixedly attached to the pintle 22. Upon contact with the pintle stop fixedly attached to the pintle 22, the force of the armature portion 21 causes the pintle 22 to be urged in the second direction 82 with the armature portion 21. The armature portion 21 may include protuberances to engage with various stops within the fuel injector 10.

An annular electromagnet assembly 24, including an electrical coil and magnetic core, is configured to magnetically engage the armature portion 21 of the valve assembly. The electrical coil and magnetic core assembly 24 is depicted for illustration purposes to be outside of the body of the fuel injector; however, embodiments herein are directed toward the electrical coil and magnetic core assembly 24 to be either integral to, or integrated within, the fuel injector 10. The electrical coil is wound onto the magnetic core, and includes terminals for receiving electrical current from the injector driver 50. Hereinafter, the "electrical coil and magnetic core assembly" will simply be referred to as an "electrical coil 24". When the electrical coil 24 is deactivated and de-energized, the spring 26 urges the valve assembly 18 including the needle valve 20 toward the fuel nozzle 28 in the first direction 81 to close the needle valve 20 and prevent fuel flow therethrough. When the electrical coil 24 is activated and energized, electromagnetic force (herein after "magnetic force") acts on the armature portion 21 to overcome the spring force exerted by the spring 26 and urges the valve assembly 18 in the second direction 82, moving the needle valve 20 away from the fuel nozzle 28 and permitting flow of pressurized fuel within the valve assembly 18 to flow through the fuel nozzle 28. A search coil 25 is mutually magnetically coupled to the electrical coil 24 and is preferably wound axially or radially adjacent coil 24. Search coil 25 is utilized as a sensing coil. The fuel injector 10 may include a stopper 29 that interacts with the valve assembly 18 to stop translation of the valve assembly 18 when it is urged to open. In one embodiment, a pressure sensor 32 is configured to obtain fuel pressure 34 in the high-pressure fuel line 30 proximal to the fuel injector 10, preferably upstream of the fuel injector 10. In another embodiment, a pressure sensor may be integrated within the inlet 15 of the fuel injector in lieu of the pressure sensor 32 in the fuel rail 30 or in combination with the pressure sensor. The fuel injector 10 in the illustrated embodiment of FIG. 1-1 is not limited to the spatial and geometric arrangement of the features described herein, and may include additional features and/or other spatial and geometric arrangements known in the art for operating the fuel injector 10 between open and closed positions for controlling the delivery of fuel to the engine 100.

The control module 60 generates an injector command (actuator command) signal 52 that controls the injector driver 50, which activates the fuel injector 10 to the open position for affecting a fuel injection event. In the illustrated embodiment, the control module 60 communicates with one or more external control modules such as an engine control module (ECM) 5; however, the control module 60 may be integral to the ECM in other embodiments. The injector command signal 52 correlates to a desired mass of fuel to be delivered by the fuel injector 10 during the fuel injection event. Similarly, the injector command signal 52 may correlate to a desired fuel flow rate to be delivered by the fuel injector 10 during the fuel injection event. As used herein, the term "desired injected fuel mass" refers to the desired mass of fuel to be delivered to the engine by the fuel injector 10. As used herein, the term "desired fuel flow rate" refers to the rate at which fuel is to be delivered to the engine by the fuel injector 10 for achieving the desired mass of fuel. The desired injected fuel mass can be based upon one or more monitored input parameters 51 input to the control module 60 or ECM 5. The one or more monitored input parameters 51 may include, but are not limited to, an operator torque request, manifold absolute pressure (MAP), engine speed, engine temperature, fuel temperature, and ambient temperature obtained by known methods. The injector driver 50 generates an injector activation (actuator activation) signal 75 in response to the injector command signal 52 to activate the fuel injector 10. The injector activation signal 75 controls current flow to the electrical coil 24 to generate electromagnetic force in response to the injector command signal 52. An electric power source 40 provides a source of DC electric power for the injector driver 50. In some embodiments, the DC electric power source provides low voltage, e.g., 12 V, and a boost converter may be utilized to output a high voltage, e.g., 24V to 200 V, that is supplied to the injector driver 50. When activated using the injector activation signal 75, the electromagnetic force generated by the electrical coil 24 urges the armature portion 21 in the second direction 82. When the armature portion 21 is urged in the second direction 82, the valve assembly 18 in consequently caused to urge or translate in the second direction 82 to an open position, allowing pressurized fuel to flow therethrough. The injector driver 50 controls the injector activation signal 75 to the electrical coil 24 by any suitable method, including, e.g., pulsewidth-modulate (PWM) electric power flow. The injector driver 50 is configured to control activation of the fuel injector 10 by generating suitable injector activation signals 75. In embodiments that employ a plurality of successive fuel injection events for a given engine cycle, an injector activation signal 75 that is fixed for each of the fuel injection events within the engine cycle may be generated.

The injector activation signal 75 is characterized by an injection duration and a current waveform that includes an initial peak pull-in current and a secondary hold current. The initial peak pull-in current is characterized by a steady-state ramp up to achieve a peak current, which may be selected as described herein. The initial peak pull-in current generates electromagnetic force that acts on the armature portion 21 of the valve assembly 18 to overcome the spring force and urge the valve assembly 18 in the second direction 82 to the open position, initiating flow of pressurized fuel through the fuel nozzle 28. When the initial peak pull-in current is achieved, the injector driver 50 reduces the current in the electrical coil 24 to the secondary hold current. The secondary hold current is characterized by a somewhat steady-state current that is less than the initial peak pull-in current. The secondary hold current is a current level controlled by the injector driver 50 to maintain the valve assembly 18 in the open position to continue the flow of pressurized fuel through the fuel nozzle 28. The secondary hold current is preferably indicated by a minimum current level. When very small fuel quantities are required, the activation current waveform will not reach its peak and the current hold phase will be omitted in that case. The injector driver 50 is configured as a bi-directional current driver capable of providing a negative current flow for drawing current from the electrical coil 24. As used herein, the term "negative current flow" refers to the direction of the current flow for energizing the electrical coil to be reversed. Accordingly, the terms "negative current flow" and "reverse current flow" are used interchangeably herein.

Embodiments herein are directed toward controlling the fuel injector for a plurality of fuel injection events that are closely-spaced during an engine cycle. As used herein, the term "closely-spaced" refers to a dwell time between each consecutive fuel injection event being less than a predetermined dwell time threshold. As used herein, the term "dwell time" refers to a period of time between an end of injection for the first fuel injection event (actuator event) and a start of injection for a corresponding second fuel injection event (actuator event) of each consecutive pair of fuel injection events. The dwell time threshold can be selected to define a period of time such that dwell times less than the dwell time threshold are indicative of producing instability and/or deviations in the magnitude of injected fuel mass delivered for each of the fuel injection events. The instability and/or deviations in the magnitude of injected fuel mass may be responsive to a presence of secondary magnetic effects. The secondary magnetic effects include persistent eddy currents and magnetic hysteresis within the fuel injector and a residual flux based thereon. The persistent eddy currents and magnetic hysteresis are present due to transitions in initial flux values between the closely-spaced fuel injection events. Accordingly, the dwell time threshold is not defined by any fixed value, and selection thereof may be based upon, but not limited to, fuel temperature, fuel injector temperature, fuel injector type, fuel pressure and fuel properties such as fuel types and fuel blends. As used herein, the term "flux" refers to magnetic flux indicating the total magnetic field generated by the electrical coil 24 and passing through the armature portion. Since the turns of the electrical coil 24 link the magnetic flux in the magnetic core, this flux can therefore be equated from the flux linkage. The flux linkage is based upon the flux density passing through the armature portion, the surface area of the armature portion adjacent to the air gap and the number of turns of the coil 24. Accordingly, the terms "flux", "magnetic flux" and "flux linkage" will be used interchangeably herein unless otherwise stated.

For fuel injection events that are not closely spaced, a fixed current waveform independent of dwell time may be utilized for each fuel injection event because the first fuel injection event of a consecutive pair has little influence on the delivered injected fuel mass of the second fuel injection event of the consecutive pair. However, the first fuel injection event may be prone to influence the delivered injected fuel mass of the second fuel injection event, and/or further subsequent fuel injection events, when the first and second fuel injection events are closely-spaced and a fixed current wave form is utilized. Any time a fuel injection event is influenced by one or more preceding fuel injection events of an engine cycle, the respective delivered injected fuel mass of the corresponding fuel injection event can result in an unacceptable repeatability over the course of a plurality of engine cycles and the consecutive fuel injection events are considered closely-spaced. More generally, any consecutive actuator events wherein residual flux from the preceding actuator event affects performance of the subsequent actuator event relative to a standard, for example relative to performance in the absence of residual flux, are considered closely-spaced.

Exemplary embodiments are further directed toward providing feedback signal(s) 42 from the fuel injector 10 to the activation controller 80. Discussed in greater detail below, sensor devices may be integrated within the fuel injector 10 for measuring various fuel injector parameters for obtaining the flux linkage of the electrical coil 24, voltage of the electrical coil 24 and current through the electrical coil 24. A current sensor may be provided on a current flow path between the activation controller 80 and the fuel injector to measure the current provided to the electrical coil 24, or the current sensor can be integrated within the fuel injector 10 on the current flow path. The fuel injector parameters provided via feedback signal(s) 42 may include the flux linkage, voltage and current directly measured by corresponding sensor devices integrated within the fuel injector 10. Additionally or alternatively, the fuel injector parameters may include proxies provided via feedback signal(s) 42 to—and used by—the control module 60 to estimate the flux linkage, magnetic flux, the voltage, and the current within the fuel injector 10. Having feedback of the flux linkage of the electrical coil 24, the voltage of the electrical coil 24 and current provided to the electrical coil 24, the control module 60 may advantageously modify the activation signal 75 to the fuel injector 10 for multiple consecutive injection events. It will be understood that conventional fuel injectors controlled by open loop operation, are based solely upon a desired current waveform obtained from look-up tables, without any information related to the force producing component of the flux linkage (e.g., magnetic flux) affecting movement of the armature portion 21. As a result, conventional feed-forward fuel injectors that only account for current flow for controlling the fuel injector, are prone to instability in consecutive fuel injection events that are closely-spaced.

It is known when the injector driver 50 only provides current uni-directionally in a positive first direction to energize the electrical coil 24, releasing the current to remain stable at zero will result in the magnetic flux within the fuel injector to gradually decay, e.g., taper off, towards zero. However, the response time for the magnetic flux to decay is slow, and the presence of magnetic hysteresis within the fuel injector often results in the presence of residual flux when a subsequent closely-spaced fuel injection event is initiated. As aforementioned, the presence of the residual flux impacts the accuracy of the fuel flow rate and injected fuel mass to be delivered in a subsequent closely-spaced fuel injection event.

Figures 1, 2:
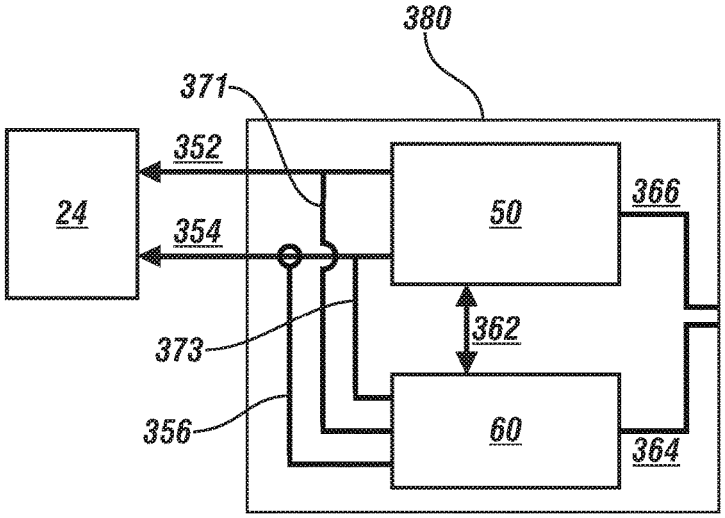

FIG. 1-2 illustrates the activation controller 80 of FIG. 1-1, in accordance with the present disclosure. Signal flow path 362 provides communication between the control module 60 and the injector driver 50. For instance, signal flow path 362 provides the injector command signal (e.g., command signal 52 of FIG. 1-1) that controls the injector driver 50. The control module 60 further communicates with the external ECM 5 via signal flow path 364 within the activation controller 380 that is in electrical communication with a power transmission cable. For instance, signal flow path 364 may provide monitored input parameters (e.g., monitored input parameters 51 of FIG. 1-1) from the ECM 5 to the control module 60 for generating the injector command signal 52. In some embodiments, the signal flow path 364 may provide feedback fuel injector parameters (e.g., feedback signal(s) 42 of FIG. 1-1) to the ECM 5.

The injector driver 50 receives DC electric power from the power source 40 of FIG. 1-1 via a power supply flow path 366. The signal flow path 364 can be eliminated by use of a small modulation signal added to the power supply flow path 366. Using the received DC electric power, the injector driver 50 may generate injector activation signals (e.g., injector activation signals 75 of FIG. 1-1) based on the injector command signal from the control module 60.

The injector driver 50 is configured to control activation of the fuel injector 10 by generating suitable injector activation signals 75. The injector driver 50 is a bi-directional current driver providing positive current flow via a first current flow path 352 and negative current flow via a second current flow path 354 to the electrical coil 24 in response to respective injector activation signals 75. The positive current via the first current flow path 352 is provided to energize an electrical coil 24 and the negative current via the second current flow path 354 reverses current flow to draw current from the electrical coil 24. Current flow paths 352 and 354 form a closed loop; that is, a positive current into 352 results in an equal and opposite (negative) current in flow path 354, and vice versa. Signal flow path 371 can provide a voltage of the first current flow path 352 to the control module 60 and signal flow path 373 can provide a voltage of the second current flow path 354 to the control module 60. The voltage and current applied to the electrical coil 24 is based on a difference between the voltages at the signal flow paths 371 and 373. In one embodiment, the injector driver 50 utilizes open loop operation to control activation of the fuel injector 10, wherein the injector activation signals are characterized by precise predetermined current waveforms. In another embodiment, the injector driver 50 utilizes closed loop operation to control activation of the fuel injector 10, wherein the injector activation signals are based upon fuel injector parameters provided as feedback to the control module, via the signal flow paths 371 and 373. A measured current flow to the coil 24 can be provided to the control module 60, via signal flow path 356. In the illustrated embodiment, the current flow is measured by a current sensor on the second current flow path 354. The fuel injector parameters may include flux linkage, voltage and current values within the fuel injector 10 or the fuel injector parameters may include proxies used by the control module 60 to estimate flux linkage, voltage and current within the fuel injector 10.

Figures 1, 2, 3:
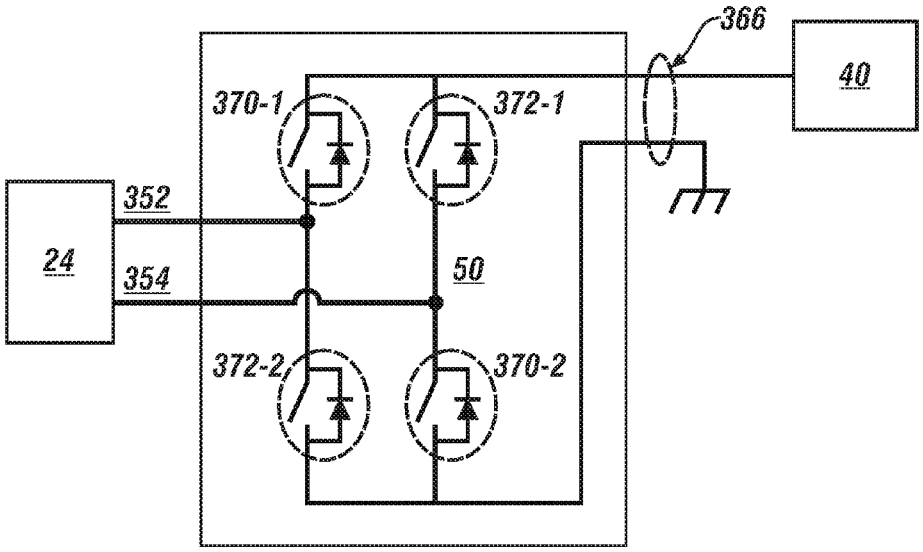
Figure 2:
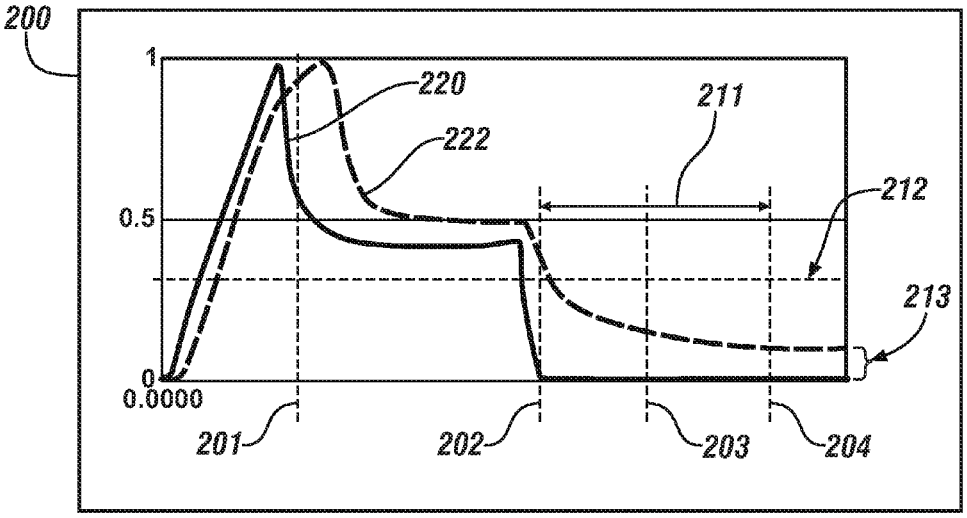
Figure 3:
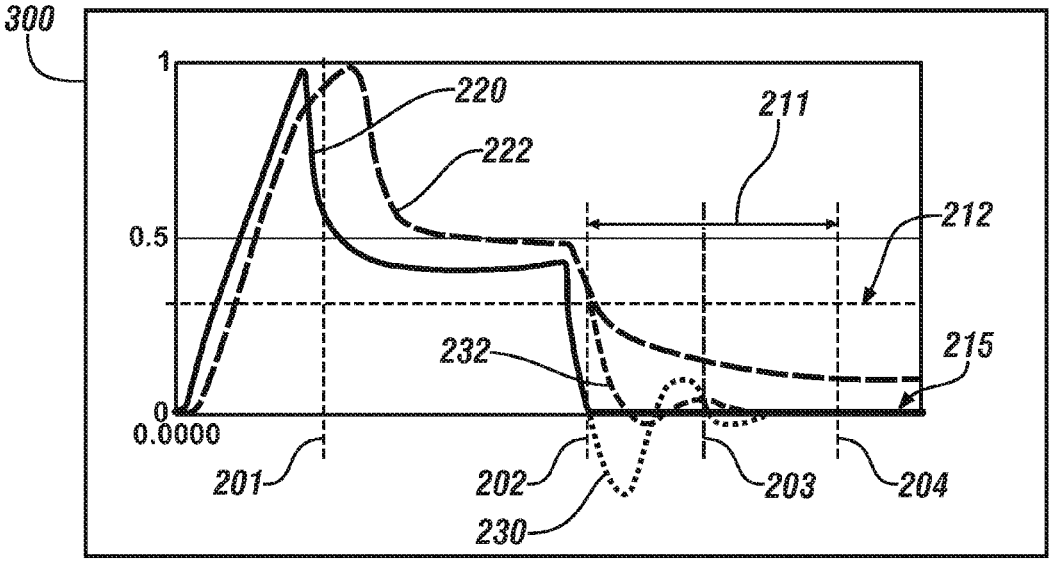

In some embodiments, the injector driver 50 is configured for full four quadrant operation. FIG. 1-3 illustrates an exemplary embodiment of the injector driver 50 of FIGS. 1-2 utilizing two switch sets 370 and 372 to control the current flow provided between the injector driver 50 and the electrical coil 24. In the illustrated embodiment, the first switch set 370 includes switch devices 370-1 and 370-2 and the second switch set 372 includes switch devices 372-1 and 372-2. The switch devices 370-1, 370-2, 372-1, 372-2 can be solid state switches and may include Silicon (Si) or wide band gap (WBG) semiconductor switches enabling high speed switching at high temperatures. The four quadrant operation of the injector driver 50 controls the direction of current flow into and out of the electrical coil 24 based upon a corresponding switch state determined by the control module 60. The control module 60 may determine a positive switch state, a negative switch state and a zero switch state and command the first and second switch sets 370 and 372 between open and closed positions based on the determined switch state. In the positive switch state, the switch devices 370-1 and 370-2 of the first switch set 370 are commanded to the closed position and the switch devices 372-1 and 372-2 of the second switch set 372 are commanded to the open position to control positive current into the first current flow path 352 and out of the second current flow path 354. These switch devices may be further modulated using pulse width modulation to control the amplitude of the current. In the negative switch state, the switch devices 370-1 and 370-2 of the first switch set 370 are commanded to the open position and the switch devices 372-1 and 372-2 of the second switch leg 372 are commanded to the closed position to control negative current into the second current flow path 354 and out of the first current flow path 352. These switch devices may be further modulated using pulse width modulation to control the amplitude of the current. In the zero switch state, all the switch devices 370-1, 370-2, 372-1, 372-2 are commanded to the open position to control no current into or out of the electromagnetic assembly. Thus, bi-directional control of current through the coil 24 may be effected.

In some embodiments, the negative current for drawing current from the electrical coil 24 is applied for a sufficient duration for reducing residual flux within the fuel injector 10 after a secondary hold current is released. In other embodiments, the negative current is applied subsequent to release of the secondary hold current but additionally only after the fuel injector has closed or actuator has returned to its static or rest position. Moreover, additional embodiments can include the switch sets 370 and 372 to be alternately switched between open and closed positions to alternate the direction of the current flow to the coil 24, including pulse width modulation control to effect current flow profiles. The utilization of two switch sets 370 and 372 allows for precise control of current flow direction and amplitude applied to the current flow paths 352 and 354 of the electrical coil 24 for multiple consecutive fuel injection events during an engine event by reducing the presence of eddy currents and magnetic hysteresis within the electrical coil 24.

FIG. 2 illustrates a non-limiting exemplary plot 200 of current flow profile (solid line) 220 and magnetic flux profile (broken line) 222 within a fuel injector for a fuel injection event without the benefit of residual flux reset or internal magnetic state reset, in accordance with the present disclosure. The horizontal x-axis denotes time increasing from zero at the origin. The vertical y-axis denotes a scaled magnitude from zero at the origin for measured current flow through the fuel injector and measured magnetic flux within the fuel injector. The current flow profile (solid line) 220 is uni-directional and indicative of a current waveform for the fuel injection event that includes an initial peak pull-in current followed by a secondary hold current. In very small quantity injections, or otherwise rapid actuator cycling, the current hold period may not be present.

Dashed vertical lines 201 and 203 represent opening and closing times of the fuel injector, respectively. Dashed vertical line 202 represents a time whereat the secondary hold current is entirely released to zero. A time period 211 between dashed vertical lines 202 and 204, represents a period of persistent magnetic flux due to eddy currents. Dashed horizontal line 212 represents a minimum steady state current threshold required to open the fuel injector. For instance, a current for energizing an electrical coil that is greater than the minimum current threshold is sufficient for generating electromagnetic force that overcomes a preload condition of an armature to effect opening of the fuel injector. As such, currents through the electrical coil that exceed the minimum current threshold open the fuel injector.

When the secondary hold current is released to zero at dashed vertical line 202, the magnetic flux profile (broken line) 222 is slowly reduced toward zero due to persistent eddy currents and hysteretic behavior of the magnetic material of the actuator. However, the magnetic flux profile (broken line) 222 does not return to zero and indicates an undesirable level of residual magnetic flux 213 present within the fuel injector at steady state. This undesirable level of residual flux 213 is the result of magnetic hysteresis within the fuel injector or actuator.

FIG. 3 illustrates a non-limiting exemplary plot 300 of current and magnetic flux profiles for the fuel injection event of FIG. 2 using a flux reset event to reduce residual flux to levels below that passively attained within the actuator at zero coil current and preferably to zero, in accordance with the present disclosure. Passive residual flux will refer to the level of residual flux within the actuator when the coil current is released to zero subsequent to an actuation event. Plot 300 illustrates initiation of the flux reset event when the secondary hold current of the current flow profile (solid line) 220 is released to zero at dashed vertical line 202. The flux reset event includes a current flow profile exhibiting at least one duration of negative current flow or current direction reversal from the preceding actuation event which effects a magnetic flux through the actuator in opposition to the residual flux. Such a current reversal subsequent to an actuation event may be referred to as a residual flux reset current flow profile. Preferably, the flux reset event includes a residual flux reset current flow profile (dotted line) 230, wherein positive and negative current flow through the coil is alternated. Each time the current flow reverses from negative to positive, the resulting positive peak amplitude has a magnitude that is less than the magnitude of the previous negative peak amplitude of the negative current flow it was reversed from. Likewise, each time the current flow reverses from positive to negative, the resulting negative peak amplitude has a magnitude that is less than the magnitude of the positive peak amplitude of the previous positive current flow it was reversed from. In other words, the amplitude of the alternating current decreases monotonically. The residual flux reset current flow profile (dotted line) 230 includes reversing the current flow through the fuel injector in the negative direction to an initial negative peak amplitude after dashed vertical line 202. It will be understood that the initial negative peak amplitude is a predetermined negative value selected to not cause undesirable motion of the armature within the fuel injector if a magnitude of the negative current exceeds the predetermined negative value. Thus this initial negative peak amplitude preferably has an absolute value or magnitude less than or equal to the minimum steady state current threshold required to open the fuel injector or otherwise magnetically displace the armature of the actuator. In response to the negative current through the fuel injector, magnetic flux profile (dashed line) 232 indicates the magnetic flux within the fuel injector is responsively reduced below the passive residual flux level and preferably approaches zero in the absence of some other non-zero level preference. In some instances, the magnetic flux may be reduced below zero (i.e. reversed) requiring the residual flux reset current flow profile (dotted line) 230 to also reverse. Such positive and negative currents can effect a tapering the magnetic flux toward a zero steady state flux 215.

The flux reset event illustrated in the non-limiting plot 300 of FIG. 3 can be executed by the activation controller 80 of FIGS. 1-1 and 1-2, wherein the injector activation signals 75 correspond to the residual flux reset current flow profile (dotted line) 230. It will be understood that the positive current of the residual flux reset current flow profile (dotted line) 230 should never include peak amplitudes greater than the minimum current threshold required to open the fuel injector at dashed horizontal line 212. Likewise, the negative current of the residual flux reset current flow profile (dotted line) 230 should never include negative peak amplitudes having magnitudes that exceed the predetermined negative value.

In one embodiment, the activation controller 80 executes the flux reset event utilizing closed loop operation. Here, magnetic flux (or flux linkage) within the fuel injector 10 is provided via feedback signal(s) 42. Based upon the magnetic flux feedback, the injector activation commands 75 can control the residual flux reset current flow profile (dotted line) 230 to reduce residual flux below the passive residual flux level. In another embodiment, the activation controller 80 executes the flux reset event utilizing open loop operation. Here, a desired or prescribed residual flux reset current flow profile (dotted line) 230 is used to reduce residual flux below the passive residual flux level.

Figure 4:
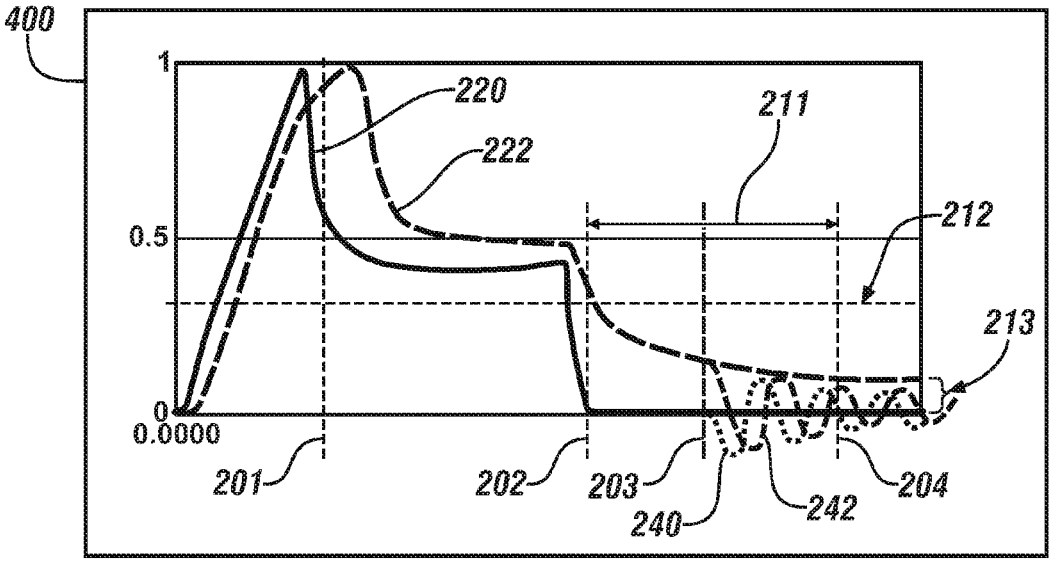
FIG. 4 illustrates a non-limiting exemplary plot of current flow and magnetic flux profiles for the fuel injection event of FIG. 2 using a flux reset event initiated after the fuel injector closes to reduce residual flux to zero, in accordance with the present disclosure.

FIG. 4 illustrates a non-limiting exemplary plot 400 of current flow and magnetic flux profiles for the fuel injection event of FIG. 2 using a flux reset event initiated subsequent to release of the secondary hold current but only after the fuel injector closes to reduce residual flux below the passive residual flux level. Such a delay is desirable in applications wherein the time at which the static or rest position of the actuator (i.e. the injector closing time) is desirably known. The initiation of the flux reset event prior to injector closure may interfere with sensing of the closure and result in an indeterminate closing time. Similar to the flux reset event illustrated in the non-limiting plot 300 of FIG. 3, the flux reset event of plot 400 includes a residual flux reset current flow profile (dotted line) 240, wherein positive and negative current flow through the fuel injector (e.g., electromagnetic coil) is alternated. However, plot 400 illustrates initiation of the flux reset event at the injector closing time at dashed vertical line 203. Thus, once the secondary hold current is released to zero at dashed vertical line 202, no current flows through the fuel injector until the injector closing time at dashed vertical line 203. At the injector closing time 203, the residual flux reset current flow profile (dotted line) 240 includes reversing the current flow through the fuel injector in the negative direction to the initial negative peak amplitude that does not exceed the predetermined negative value. Thereafter, the residual flux reset current flow profile (dotted line) 240 of the flux reset event includes an exponentially decaying alternating current flow that alternates between positive and negative current flow. As shown by magnetic flux profile (dashed line) 242 corresponding to the residual flux reset current flow profile (dotted line) 240, the residual flux exponentially decays below the passive residual flux level and approaches zero.

The flux reset event illustrated in the non-limiting plot 400 of FIG. 4 using the exponentially decaying residual flux reset current flow profile (dotted line) 240 can be executed by the activation controller 80 of FIGS. 1-1 and 1-2, wherein the injector activation signals 75 correspond to the residual flux reset current flow profile (dotted line) 240. It will be understood that the positive current of the residual flux reset current flow profile (dotted line) 240 should never include peak amplitudes greater than the minimum current threshold required to open the fuel injector at dashed horizontal line 212. Likewise, the negative current of the residual flux reset current flow profile (dotted line) 240 should never include negative peak amplitudes having magnitudes that exceed the predetermined negative value. The activation controller 80 can monitor when the fuel injector closes to initiate the flux reset event. For example, it is known to monitor coil voltage subsequent to an actuation when current is no longer being driven into the coil to look for a voltage signature (e.g. predetermined time rate of change) indicative of the armature reaching a rest position. The activation controller 80 may further select a frequency at which the bi-directional current exponentially decays to yield desired values of residual flux prior to a subsequent fuel injection event.

Figure 5:
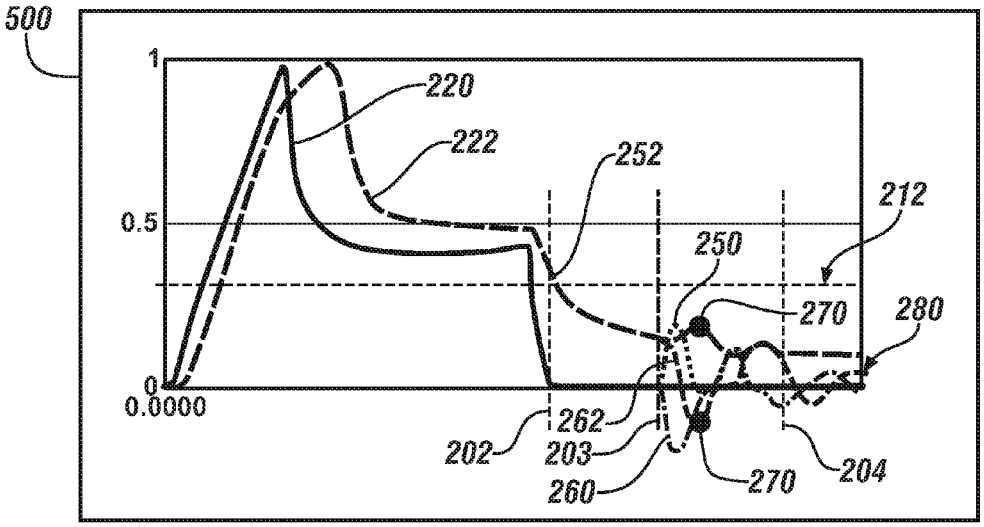
FIG. 5 illustrates a non-limiting exemplary plot of current flow and magnetic flux profiles for the fuel injection event of FIG. 4 using a bi-directional armature bounce control and residual flux reduction strategy, in accordance with the present disclosure.

FIG. 5 illustrates a non-limiting exemplary plot 500 of current and magnetic flux profiles for the fuel injection event of FIG. 2 using an armature bounce control and residual flux reduction strategy. Generally, it is known to control undesirable movement of an armature of a fuel injector after a fuel injection event once the fuel injector has been closed, or more generally to reduce bounce of an armature when it has returned to its static or rest position subsequent to an actuation event. For instance, the armature portion 21 illustrated in FIG. 1-1 may slightly translate in the first and second directions 81, 82, respectively, at the end of a fuel injection event when the fuel injector achieves the closed position. This undesirable movement can be referred to as armature bounce. In known conventional fuel injectors having uni-directional current delivery, armature bounce may be controlled by a uni-directional armature bounce control event that includes a series of successive uni-directional current pulses beginning at the injector closing time (dashed vertical line) 203, wherein each current pulse starts from zero and increases to a respective amplitude that is less than an amplitude of an immediately preceding current pulse. Uni-directional current flow profile (dotted line) 250 illustrates the series of successive uni-directional (i.e. positive) current pulses of the conventional uni-directional armature bounce control event beginning at dashed vertical line 203. A uni-directional magnetic flux profile (following broken line) 252 corresponding to the uni-directional current flow profile (dotted line) 250, illustrates a reducing trend of magnetic flux within the fuel injector that includes a series of decreasing amplitudes responsive to the uni-directional current flow profile (dotted line) 250 for affecting desired magnetic forces to control the armature bounce. However, the uni-directional magnetic flux profile (following broken line) 252 indicates the presence of the undesirable level of residual flux still at or above a passive residual flux level, as previously discussed above with reference to the non-limiting exemplary plot 200 of FIG. 2 when no flux reset event or flux reduction strategy is used.

Exemplary embodiments herein are directed toward utilizing the bi-directional armature bounce control and residual flux reduction strategy to simultaneously control armature bounce while reducing residual flux to below the passive residual flux level at steady state 280. When the secondary hold current is released to zero at dashed vertical line 202, no current flows through the fuel injector until the injector closing time at dashed vertical line 203. The bi-directional armature bounce control and residual flux reduction strategy includes a residual flux reset current flow profile (dash-dot line) 260 initiated at the injector closing time at dashed vertical line 203, wherein positive and negative current flow through the fuel injector (e.g., electromagnetic coil) is alternated. Each time the current flow reverses from negative to positive, the resulting positive peak amplitude has a magnitude that is less than the magnitude of the previous negative peak amplitude of the negative current flow it was reversed from. Likewise, each time the current flow reverses from positive to negative, the resulting negative peak amplitude has a magnitude that is less than the magnitude of the positive peak amplitude of the previous positive current flow it was reversed from.

At the injector closing time 203, the residual flux reset current flow profile (dash-dot line) 260 includes reversing the current flow through the fuel injector in the negative direction to an initial negative peak amplitude that does not exceed the predetermined negative value. It will be understood that magnitudes of negative current exceeding the predetermined negative value may result in undesirable movement of the armature of the fuel injector. For controlling armature bounce, the alternating currents of the residual flux reset current flow profile (dash-dot line) 260 may include the same wave shape as the positive current of the uni-directional current flow profile (dotted line) 250. Magnetic flux profile (dashed line) 262 corresponding to the residual flux reset current flow profile (dash-dot line) 260, illustrates the magnetic flux is driven to an initial negative peak amplitude responsive to the initial negative peak amplitude of the residual flux reset current flow profile (dash-dot line) 260. Points 270 illustrate that the initial negative peak amplitude of magnetic flux profile (dashed line) 262 is identical to an initial peak amplitude of the uni-directional magnetic flux profile 252 resulting in similar magnetic force acting on the armature as in the uni-directional case. Therefore, the initial negative peak amplitude of magnetic flux profile (dashed line) 262 affects a desired magnetic force for controlling armature bounce. Magnetic flux profile (dashed line) 262 illustrates magnetic residual flux is reduced to below the passive residual flux level at steady state 280. Accordingly, the bi-directional armature bounce control and residual flux reduction strategy advantageously reduces undesirable levels of residual steady state flux that are present when the conventional uni-directional bounce control strategy without a flux reduction strategy is utilized.

The bi-directional armature bounce control and residual flux reduction strategy illustrated in the non-limiting plot 500 of FIG. 5 can be executed by the activation controller 80 of FIGS. 1-1 and 1-2, wherein the injector activation signals 75 correspond to the residual flux reset current flow profile (dash-dot line) 260. It will be understood that the positive current of the residual flux reset current flow profile (dash-dot line) 260 should never include peak amplitudes greater than the minimum current threshold required to open the fuel injector at dashed horizontal line 212. Likewise, the negative current of the residual flux reset current flow profile (dash-dot line) 260 should never include negative peak amplitudes having magnitudes that exceed the predetermined negative value. The activation controller 80 can monitor when the fuel injector closes to initiate the strategy. The activation controller 80 may further select a frequency at which the bi-directional current alternates to yield desired values of residual flux prior to a subsequent fuel injection event.

The figures of this disclosure have illustrated exemplary residual flux reset current flow profiles that appear substantially sinusoidal in shape. However, such current flow profiles are not intended to be limiting. In fact, one skilled in the art will recognize that various other current flow profiles including, for example, triangular or sawtooth (of consistent or varying slopes), square wave (of consistent or varying pulse-widths and duty cycles), arbitrary or other shapes may be employed. As well, residual flux reset current flow profiles may follow decay profiles other than exponential. Moreover, decay time constants may similarly be different from those shown in the illustrations, keeping in mind that the figures are not to be interpreted as providing any particular relative or absolute decay time constants.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for controlling an electromagnetic actuator, comprising:

driving current though an electrical coil of the actuator in a first direction when an actuation is desired; and, when the actuation is not desired driving current through the electrical coil including in a second direction sufficient to reduce residual flux within the actuator below a level passively attained within the actuator at zero coil current.

2. The method for controlling an electromagnetic actuator of claim 1, wherein driving current through the electrical coil including in a second direction occurs only after the actuator has returned to a rest position.

3. The method for controlling an electromagnetic actuator of claim 1, wherein driving current through the electrical coil including in a second direction comprises: driving current alternately between the second direction and the first direction.

4. The method for controlling an electromagnetic actuator of claim 3, wherein driving current alternately between the second direction and the first direction comprises exponentially decaying the driving current.

5. The method for controlling an electromagnetic actuator of claim 3, wherein driving current alternately between the second direction and the first direction occurs only after the actuator has returned to a rest position, further comprising driving current alternately between the second direction and the first direction sufficient to reduce armature bounce.

6. The method for controlling an electromagnetic actuator of claim 3, wherein driving current alternately between the second direction and the first direction comprises driving current in a sinusoidal fashion.

7. The method for controlling an electromagnetic actuator of claim 3, wherein driving current alternately between the second direction and the first direction comprises driving current in a square wave fashion.

8. The method for controlling an electromagnetic actuator of claim 3, wherein driving current alternately between the second direction and the first direction comprises driving current in a sawtooth fashion.

9. An electromagnetic actuation system, comprising:

an electrical coil;

a magnetic core;

an armature;

a controllable bi-directional drive circuit for selectively driving current through the coil in either of two directions; and a control module providing an actuator command to the drive circuit effective to drive current through the coil in a first direction when armature actuation is desired, and subsequent to armature actuation effective to drive current through the coil including in a second direction sufficient to oppose residual flux within the actuator.

10. The electromagnetic actuation system of claim 9, wherein said control module provides said actuator command to the drive circuit subsequent to armature actuation effective to drive current through the coil including in the second direction sufficient to oppose residual flux within the actuator only after the actuator has returned to a rest position.

11. The electromagnetic actuation system of claim 9, wherein said control module providing said actuator command to the drive circuit subsequent to armature actuation effective to drive current through the coil including in the second direction sufficient to oppose residual flux within the actuator comprises said actuator command effective to drive current alternately between the second direction and the first direction.

12. The electromagnetic actuation system of claim 11, wherein said control module providing said actuator command to the drive circuit subsequent to armature actuation effective to drive current through the coil including in the second direction sufficient to oppose residual flux within the actuator comprises said actuator command effective to drive current alternately between the second direction and the first direction with an exponential decay.

13. The electromagnetic actuation system of claim 11, wherein said control module provides said actuator command to the drive circuit subsequent to armature actuation effective to drive current through the coil including in the second direction sufficient to oppose residual flux within the actuator only after the actuator has returned to a rest position, further comprising said control module providing said actuator command to the drive circuit subsequent to armature actuation effective to drive current through the coil including in the second direction sufficient to reduce armature bounce.

14. The electromagnetic actuation system of claim 11, wherein said control module providing said actuator command to the drive circuit subsequent to armature actuation effective to drive current through the coil including in the second direction sufficient to oppose residual flux within the actuator comprises said actuator command effective to drive current alternately between the second direction and the first direction in a sinusoidal fashion.

15. The electromagnetic actuation system of claim 11, wherein said control module providing said actuator command to the drive circuit subsequent to armature actuation effective to drive current through the coil including in the second direction sufficient to oppose residual flux within the actuator comprises said actuator command effective to drive current alternately between the second direction and the first direction in a square wave fashion.

16. The electromagnetic actuation system of claim 11, wherein said control module providing said actuator command to the drive circuit subsequent to armature actuation effective to drive current through the coil including in the second direction sufficient to oppose residual flux within the actuator comprises said actuator command effective to drive current alternately between the second direction and the first direction in a saw tooth fashion.

17. A device for reducing residual flux in an electromagnetic actuator, comprising:

a controllable bi-directional drive circuit configured for selectively driving current through the actuator in either of two directions; and a control module providing an actuator command to the drive circuit effective to drive current through the actuator in a first current direction to effect a magnetic flux through the actuator in a magnetic material flux path in a first direction when actuation is desired, and thereafter effective to drive current through the actuator in a second current direction to effect a magnetic flux through the actuator in a magnetic material flux path in a second direction opposite the first direction to oppose residual flux within the actuator.

* * * * *